US009458405B2

(12) United States Patent
Sakanoue et al.

(10) Patent No.: US 9,458,405 B2
(45) Date of Patent: Oct. 4, 2016

(54) LUBRICATING OIL COMPOSITION

(71) Applicant: IDEMITSU KOSAN CO., LTD., Chiyoda-ku (JP)

(72) Inventors: Shuichi Sakanoue, Ichihara (JP); Aya Aoki, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/421,206

(22) PCT Filed: Aug. 19, 2013

(86) PCT No.: PCT/JP2013/072077

§ 371 (c)(1),
(2) Date: Feb. 12, 2015

(87) PCT Pub. No.: WO2014/030608

PCT Pub. Date: Feb. 27, 2014

(65) Prior Publication Data

US 2015/0240182 A1 Aug. 27, 2015

(30) Foreign Application Priority Data

Aug. 20, 2012 (JP) ..... 2012-181766

(51) Int. Cl.
*C10M 141/10* (2006.01)
*C10M 161/00* (2006.01)

(52) U.S. Cl.
CPC ..... *C10M 161/00* (2013.01); *C10M 141/10* (2013.01); *C10M 2215/28* (2013.01); *C10M 2219/084* (2013.01); *C10M 2219/087* (2013.01); *C10M 2223/04* (2013.01); *C10N 2230/06* (2013.01); *C10N 2230/08* (2013.01); *C10N 2240/08* (2013.01)

(58) Field of Classification Search
CPC ..... C10M 161/00; C10M 141/10; C10M 2215/28; C10M 2219/084; C10M 2219/087; C10M 2223/04; C10N 2230/06; C10N 2230/08; C10N 2240/08
USPC ..... 508/287, 441, 442, 509
See application file for complete search history.

(56) References Cited

U.S. PATENT DOCUMENTS

| | | | | |
|---|---|---|---|---|
| 5,354,486 | A | 10/1994 | Evans | |
| 6,232,275 | B1 * | 5/2001 | Ichihashi | C10M 141/10 508/192 |
| 6,528,458 | B1 * | 3/2003 | Tagliamonte | C10M 135/36 508/185 |
| 2003/0096713 | A1 | 5/2003 | Schnur et al. | |
| 2004/0005988 | A1 | 1/2004 | Watanabe et al. | |
| 2004/0267042 | A1 | 12/2004 | Camenzind et al. | |
| 2009/0005274 | A1 * | 1/2009 | Swartele | C10M 169/04 508/110 |
| 2009/0312211 | A1 * | 12/2009 | Yamada | C10M 143/02 508/564 |
| 2010/0062954 | A1 * | 3/2010 | Fujita | C10M 105/04 508/110 |
| 2010/0075877 | A1 | 3/2010 | Koga | |

FOREIGN PATENT DOCUMENTS

| | | | |
|---|---|---|---|
| CN | 1234430 | A | 11/1999 |
| CN | 1510116 | A | 7/2004 |
| CN | 1720255 | A | 1/2006 |
| CN | 101495607 | A | 7/2009 |
| CN | 101517055 | A | 8/2009 |
| CN | 102498194 | A | 6/2012 |
| EP | 0 761 805 | A2 | 3/1997 |
| EP | 0 761 805 | A3 | 3/1997 |
| EP | 1 803 796 | A2 | 7/2007 |
| EP | 1 803 796 | A3 | 7/2007 |
| EP | 2 302 024 | A1 | 3/2011 |
| JP | 2-182787 | A | 7/1990 |
| JP | 02-209843 | A | 8/1990 |
| JP | 05-255683 | A | 10/1993 |
| JP | 2000-192067 | A | 7/2000 |
| JP | 2001-214184 | A | 8/2001 |
| JP | 2003-147379 | A | 5/2003 |
| JP | 2003-321695 | A | 11/2003 |
| JP | 2006-523241 | A | 10/2006 |
| JP | 2008-133332 | A | 6/2008 |
| JP | 2008-239775 | A | 10/2008 |
| WO | WO 2004/007652 | A1 | 1/2004 |
| WO | WO 2008/038667 | A1 | 4/2008 |

OTHER PUBLICATIONS

International Search Report issued Nov. 19, 2013 in PCT/JP2013/072077 Filed Aug. 19, 2013.
Notice of Reason(s) for Rejection issued Jan. 19, 2016 in Japanese Patent Application No. 2012-181766 (with English language translation).
Extended European Search Report issued Mar. 3, 2016 in Patent Application No. 13830860.6.
Combined Office Action and Search Report issued Mar. 29, 2016 in Chinese Patent Application No. 201380042633.2 (with English language translation).
"Study on new method for synthesizing a hindered-phenol-derivative-bishydrazide-(bisamide)-based antioxidant", Science Technology I series, No. 8, Aug. 15, 2006.

* cited by examiner

*Primary Examiner* — James Goloboy
(74) *Attorney, Agent, or Firm* — Oblon, McClelland, Maier & Neustadt, L.L.P.

(57) ABSTRACT

A lubricating oil composition includes: a base oil; a component (A) that is a dialkyl hydrogen phosphite; a component (B) that is a sulfur antioxidant; and a component (C) that is a polyalkenyl succinimide.
Since the lubricating oil composition of the invention exhibits an excellent lubricity to both iron metal and copper metal and an excellent heat stability, the lubricating oil composition of the invention is suitable for a shock absorber of an automobiles and the like.

10 Claims, No Drawings

LUBRICATING OIL COMPOSITION

TECHNICAL FIELD

The present invention relates to a lubricating oil composition, more specifically to a lubricating oil composition to be used for a shock absorber in an automobile and the like.

BACKGROUND ART

A shock absorber is provided between a vehicle body and tires in an automobile and absorbs vibration of the vehicle body caused by a bumpy road surface, wobble generated at sudden acceleration and sudden braking, and the like. The shock absorber is typically attached diagonally since such a diagonally attached shock absorber is superior to a vertically attached shock absorber in riding comfort of the automobile. With this arrangement, a lateral force, which is caused by a bending moment generated by expansion and contraction of the shock absorber, is applied to the shock absorber. In order to smoothly expand and contract the shock absorber while the lateral force is applied, it is required to decrease friction in a bearing (guide bush) and improve wear resistance of a shock absorber fluid (SAF).

In response to such a demand, for instance, there is provided a hydraulic fluid composition for a shock absorber including: (a) a base oil; (b) at least one compound selected from the group consisting of a phosphate ester, a phosphite ester and a phosphate ester amine salt; and (c) alkanol amine (see Patent Literature 1). Moreover, there is provided a fluid composition for an active suspension including: (A) a phosphite ester; (B) an aliphatic amine oiliness agent; and (C) fatty acid, naphthenic acid, an ester thereof, or a mixture thereof, as essential components each at a predetermined content in a lubricating base oil (see Patent Literature 2).

CITATION LIST

Patent Literature(s)

Patent Literature 1: JP-A-5-255683
Patent Literature 2: JP-A-2000-192067

SUMMARY OF THE INVENTION

Problems to be Solved by the Invention

A majority of the bearing (guide bush) of the shock absorber is a copper bearing. Accordingly, in general, a shock absorber oil aiming for the copper guide bush has been developed. However, since there is an iron guide bush among the guide bush, a shock absorber oil for the iron guide bush needs to be developed. Since it is troublesome to use different shock absorber oils depending on the material of the guide bush, it is desirable that a single type shock absorber oil is usable for two types of the guide bushes (i.e., copper and iron guide bushes).

However, it is difficult that the shock absorber oils disclosed in Patent Literatures 1 and 2 satisfy lubricity to the copper and iron guide bushes. Further, when an extreme pressure agent and an oiliness agent are added to the base oil in order to improve the lubricity to metals, heat stability is generally deteriorated.

An object of the invention is to provide a lubricating oil composition exhibiting an excellent lubricity to both iron metal and copper metal and an excellent heat stability.

Means for Solving the Problems

After dedicated study, the inventors found that a predetermined phosphorous extreme pressure agent (e.g., dilauryl hydrogen phosphite) improves lubricity to iron metal and copper metal. On the other hand, it is recognized that this additive has a poor heat stability and easily generates sludge. As a result of further consideration, the inventors found that concurrent use of a sulfur antioxidant and a polyalkenyl succinimide with the above phosphorous extreme pressure agent can improve the heat stability (sludge resistance) while maintaining the lubricity. The invention has been reached based on this finding.

Specifically, the invention provides a lubricating oil composition as follows.

(1) According to an aspect of the invention, a lubricating oil composition includes: a base oil; a component (A) that is a dialkyl hydrogen phosphite; a component (B) that is a sulfur antioxidant; and a component (C) that is a polyalkenyl succinimide.

(2) In the above aspect of the invention, the component (A) is represented by a formula (1) below.

[Formula 1]

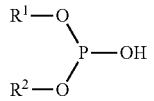

(1)

In the formula (1), $R^1$ and $R^2$ are each independently an alkyl group having 8 to 16 carbon atoms.

(3) In the above aspect of the invention, a compound as the component (A) of the formula (1) is dilauryl hydrogen phosphite.

(4) In the above aspect of the invention, the component (B) is represented by a formula (2) below.

[Formula 2]

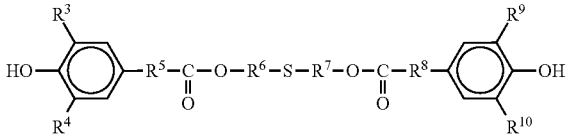

(2)

In the formula (2), $R^3$, $R^4$, $R^9$ and $R^{10}$ are each independently an alkyl group and $R^5$, $R^6$, $R^7$ and $R^8$ are each independently an alkylene group.

(5) In the above aspect of the invention, $R^3$, $R^4$, $R^9$ and $R^{10}$ in the formula (2) are each a tertiary butyl group.

(6) In the above aspect of the invention, $R^5$ and $R^8$ in the formula (2) are each an ethylene group.

(7) In the above aspect of the invention, $R^6$ and $R^7$ in the formula (2) are each an ethylene group.

(8) In the above aspect of the invention, the component (C) is polybutenyl succinimide.

(9) In the above aspect of the invention, the lubricating oil composition is used for a shock absorber.

According to the above aspect of the invention, a lubricating oil composition exhibiting an excellent lubricity to both iron metal and copper metal and an excellent heat stability can be provided. Accordingly, the lubricating oil composition according to the aspect of the invention is particularly excellent for a shock absorber of an automobile and the like.

DESCRIPTION OF EMBODIMENT(S)

A lubricating oil composition in an exemplary embodiment of the invention (hereinafter also referred to as "the present composition") is provided by blending (A) a dialkyl hydrogen phosphite, (B) a sulfur antioxidant, and (C) a polyalkenyl succinimide each at a predetermined ratio with a base oil. The present composition will be described in detail below.

Base Oil

For the base oil of the present composition, mineral oil and/or synthetic oil is typically used. The mineral oil and synthetic oil are not particularly limited by types and others. Examples of the mineral oil are a paraffinic mineral oil, an intermediate mineral oil and a naphthenic mineral oil, which are obtained by typical purification methods such as solvent purification and hydrogenation purification.

Examples of the synthetic oil are polybutene, polyolefin (α-olefin (co)polymer), various esters (e.g., polyol ester, diacid ester and phosphoric ester), various ethers (e.g., polyphenylether), alkylbenzene, alkyl naphthalene and GTL (Gas to Liquids).

In the exemplary embodiment, one of the above mineral oils may be used alone or a combination of two or more thereof may be used as the base oil. Alternatively, one of the above synthetic oils may be used alone or a combination of two or more thereof may be used. Further, a combination of at least one of the above mineral oil and at least one of the above synthetic oil may be used.

Since the present composition is used as the shock absorber oil mainly in a passenger car, the base oil preferably has a kinematic viscosity at 40 degrees C. in a range of 4 $mm^2/s$ to 10 $mm^2/s$ in terms of low-temperature fluidity, vaporizability, foaming properties and damping force properties.

Component (A)

A component (A) in the present composition is a dialkyl hydrogen phosphite, which is particularly preferably represented by a formula (1) below.

[Formula 3]

(1)

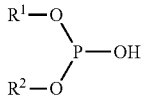

Herein, $R^1$ and $R^2$ in the formula (1) independently represent an alkyl group having 8 to 16 carbon atoms. $R^1$ and $R^2$ may be the same as or different from each other. When the alkyl group has 8 or more carbon atoms, oxidation stability of the lubricating oil composition is not likely to be deteriorated. When the alkyl group has 16 or less carbon atoms, wear resistance between metals is not likely to become insufficient.

Specific examples of the compound of the formula (1) are dilauryl hydrogen phosphite, di-2-ethylhexyl hydrogen phosphite, dipalmityl hydrogen phosphite, di-n-octyl hydrogen phosphite, dipentadecyl hydrogen phosphite, ditetradecyl phosphite, and ditridecyl hydrogen phosphite.

In the present composition, a content of the component (A) is preferably in a range of 0.01 mass % to 5 mass % of a total amount of the composition, more preferably in a range of 0.1 mass % to 1 mass %, particularly preferably in a range of 0.4 mass % to 0.6 mass %. When the content of the component (A) is equal to or more than the above lower limit, lubricity and wear resistance between metals in the lubricating oil composition can be enhanced. However, when the content of the component (A) is more than the above upper limit, metal parts may be corroded and an additive may be deposited.

Component (B)

A component (B) of the present composition is a sulfur antioxidant. Particularly, a compound having a structure represented by a formula (2) below is preferable.

[Formula 4]

(2)

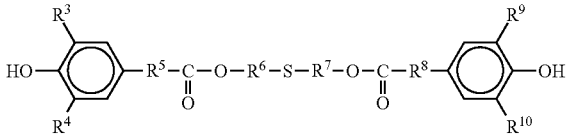

In the formula (2), $R^3$, $R^4$, $R^9$ and $R^{10}$ are each independently an alkyl group. The alkyl group is preferably a hindered alkyl group in terms of heat resistance (sludge resistance). Particularly, $R^3$, $R^4$, $R^9$ and $R^{10}$ are preferably a tertiary butyl group.

In the formula (2), $R^5$, $R^6$, $R^7$ and $R^8$ are each independently an alkylene group, which preferably has 1 to 4 carbon atoms.

Herein, $R^5$ and $R^8$ are more preferably an ethylene group in terms of antioxidant capacity and solubility in the base oil. $R^6$ and $R^7$ are also more preferably an ethylene group in terms of antioxidant capacity and solubility in the base oil.

Specific examples of the compound of the formula (2) are thiodiethylene-bis[3-(3,5-di-t-butyl-4-hydroxyphenyl)propionate] and thiodimethylene-bis[3-(3,5-di-t-butyl-4-hydroxyphenyl)propionate].

In the present composition, a content of the component (B) is preferably in a range of 0.01 mass % to 5 mass % of the total amount of the composition, more preferably in a range of 0.1 mass % to 1 mass %, particularly preferably in a range of 0.4 mass % to 0.6 mass % in order to improve the heat resistance.

Component (C)

A component (C) of the present composition is a polyalkenyl succinimide. Examples of the polyalkenyl succinimide are a mono-type polyalkenyl succinimide represented by a formula (3) below and a bis-type polyalkenyl succinimide represented by a formula (4) below.

[Formula 5]

(3)

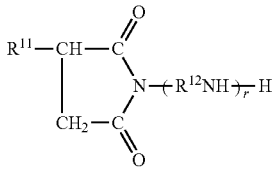

-continued

[Formula 6]

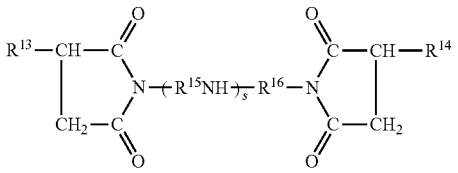

(4)

In the formulae (3) and (4), $R^{11}$, $R^{13}$ and $R^{14}$ are each a polyalkenyl group having a number average molecular weight of 500 to 4,000. $R^{13}$ and $R^{14}$ may be mutually the same or different. The number average molecular weight of each of $R^{11}$, $R^{13}$ and $R^{14}$ is preferably in a range of 1,000 to 4,000. $R^{12}$, $R^{15}$ and $R^{16}$ are each an alkylene group having 2 to 5 carbon atoms. $R^{15}$ and $R^{16}$ may be the same or different. r represents an integer of 1 to 10. s represents 0 or an integer of 1 to 10.

When the number average molecular weight of each of $R^{11}$, $R^{13}$ and $R^{14}$ is less than 500, the solubility in the base oil may be deteriorated. When the number average molecular weight of each of $R^{11}$, $R^{13}$ and $R^{14}$ exceeds 4,000, heat stability is possibly to become insufficient.

r is preferably in a range of 2 to 5, more preferably in a range of 3 to 4. When r is less than 1, the heat stability may be deteriorated. When r is 11 or more, the solubility in the base oil may be deteriorated.

In the formula (4), s is preferably in a range of 1 to 4, more preferably in a range of 2 to 3. The polyalkenyl succinimide falling within the above range is preferable in terms of the heat stability and the solubility in the base oil.

As the polyalkenyl succinimide of the formulae (3) and (4), a polybutenyl group and a polyisobutenyl group are preferable. The polybutenyl group is obtained by polymerizing a mixture of 1-butene and isobutene or by polymerizing highly-pure isobutene.

The polyalkenyl succinimide can be typically manufactured by reacting polyamine with a polyalkenyl succinic acid anhydride that is obtained by reacting polyolefin with maleic anhydride.

The mono-type succinimide and the bis-type succinimide can be manufactured by changing a reaction ratio between the polyalkenyl succinic acid anhydride and the polyamine.

Examples of the polyamine are: diamines such as ethylenediamine, propylenediamine, butylenediamine, and pentylenediamine; polyalkylene polyamines such as diethylenetriamine, triethylenetetramine, tetraethylenepentamine, pentaethylenehexamine, di(methylethylene)triamine, dibutylenetriamine, tributylenetetramine, and pentapentylenehexamine; and a piperazine derivative such as aminoethylpiperazine.

In the present composition, a content of the component (C) is preferably in a range of 0.01 mass % to 5 mass % of the total amount of the composition, more preferably in a range of 0.1 mass % to 1 mass %, further preferably in a range of 0.4 mass % to 0.6 mass %.

When the content of the component (C) is less than 0.01 mass %, it is difficult to improve the heat stability. When the content of the component (C) exceeds 5 mass %, it is unlikely to obtain effects in proportion to the content.

Since the present composition is provided by blending the components (A), (B) and (C) in the base oil, the present composition exhibits an excellent heat stability to both metals of iron and copper and an excellent heat stability. In other words, since the present composition is usable for both an iron guide bush and a copper guide bush, the present composition is suitable particularly for a shock absorber of an automobile and the like.

The present composition is suitable mainly for a shock absorber of a four-wheel vehicle, but also effective for a shock absorber of a two-wheel vehicle. Moreover, the present composition is usable for a multiple-cylinder shock absorber and a single-cylinder shock absorber. Further, the present composition is also effective as an industrial hydraulic fluid, a hydraulic fluid for construction machinery and the like.

As long as an object of the invention is not hampered, the present composition can be added as desired with other additives (e.g., a metal deactivator, an antifoaming agent, a metal detergent and an oiliness agent) typically used in lubricating oil for the shock absorber of the automobile and the like.

Examples of the metal deactivator are benzotriazole, a benzotriazole derivative, benzothiazole, a benzothiazole derivative, triazole, a triazole derivative, dithiocarbamate, a dithiocarbamate derivative, imidazole, and an imidazole derivative, which are preferably usable at a ratio in a range of 0.005 mass % to 0.3 mass %.

Examples of the antifoaming agent are fluorosilicone oil such as fluorine-modified silicone oil, silicone oil such as dimethylpolysiloxane, and polyacrylate, which are added at an extremely small amount, for instance, approximately in a range of 0.001 mass % to 0.004 mass %.

Examples of the metal detergent are alkali metal sulfonate, alkali metal phenate, alkali metal salicylate, alkali metal naphthenate, alkaline earth metal sulfonate, alkaline earth metal phenate, alkaline earth metal salicylate, and alkaline earth metal naphthenate. One of the metal detergent may be used alone or a combination of two or more thereof may be used. A content of the metal detergent is not particularly limited, but is preferably in a range of 0.1 mass % to 10 mass % based on the total amount of the composition.

Examples of the oiliness agent are a saturated or unsaturated aliphatic monocarboxyl acid such as stearic acid and olein acid, a polymerized fatty acid such as dimer acid and hydrogenated dimer acid, a hydroxyfatty acid such as ricinoleic acid and 12-hydroxystearic acid, a saturated or unsaturated aliphatic monoalcohol such as lauryl alcohol and oleyl alcohol, a saturated or unsaturated aliphatic monoamine such as stearylamine and oleylamine, an aliphatic secondary amine mixture having a hydrocarbon chain of 8 to 18 carbon atoms, a saturated or unsaturated aliphatic monocarboxyl acid amide such as lauric acid amide and olein acid amide, and a multivalent fatty acid ester such as oleic acid monoglyceride. A content of the oiliness agent is preferably in a range of 0.01 mass % to 10 mass % of the total amount of the composition, more preferably 0.1 mass % to 5 mass %.

One of the additives may be used alone or a combination of a plurality thereof may be used. The present composition does not hamper effects obtained by the additives.

EXAMPLE

Next, the invention will be further described in detail by reference to Examples, which by no means limit the invention.

Examples 1 to 2 and Comparatives 1 to 8

After preparation of lubricating oil compositions, lubricity, wear resistance and heat resistance (sludge resistance)

were evaluated. Specifically, the lubricating oil compositions (sample oils) were prepared from the base oil and the additives shown in Table 1. A kinematic friction coefficient, an area of wear track and an amount of generated sludge were measured according to the following method. The results are shown in Table 1.

Evaluation Method of Lubricity and Wear Resistance

Tester: Bowden Reciprocating Friction Tester

Experiment Conditions:

(1) Lubricity to Copper Metal

The kinematic friction coefficient (bronze μ) was measured under the following conditions. The bronze μ is desirably 0.150 or less in practical use.

Load: 4.9 N

Speed: 0.2 mm/s

Temperature: 80 degrees C.

Friction Material: bronze ball/chrome plated plate (4) Wear Resistance to Iron Metal The area of wear track on the SPCC-SD plate was calculated under the following conditions. The area of wear track is desirably 0.100 $mm^2$ or less in practical use.

Load: 4.9 N

Speed: 8.0 mm/s

Temperature: 80 degrees C.

Friction Material: SUJ2 steel ball/SPCC-SD plate

Test Time: 30 min

Evaluation Method of Heat Resistance 100 mL of each of the sample oils, an iron catalyst and a copper catalyst were put in a glass bottle having am inner volume of 100 mL, where aging was conducted for 168 hours at 120 degrees C. A millipore value (attached amount to a filter) after the aging was measured and defined as the amount of generated sludge (in accordance with JIS K 2514-1996).

TABLE 1

| | | Example 1 | Example 2 | Comparative 1 | Comparative 2 | Comparative 3 | Comparative 4 | Comparative 5 | Comparative 6 | Comparative 7 | Comparative 8 |
|---|---|---|---|---|---|---|---|---|---|---|---|
| Base Oil (mass %) | mineral oil[1)] | 98.50 | 98.50 | 98.50 | 99.00 | 99.50 | 99.50 | 99.50 | 99.00 | 99.50 | 100.00 |
| Additive (mass %) | dilauryl hydrogen phosphite (Component A) | 0.50 | 0.50 | 0.50 | 0.50 | 0.50 | — | — | — | — | — |
| | thiodiethylene-bis[3-(3,5-di-t-butyl-4-hydroxyphenyl)propionate] [2)] (Component B) | 0.50 | — | — | 0.50 | — | — | — | — | — | — |
| | thiodimethylene-bis[3-(3,5-di-t-butyl-4-hydroxyphenyl)propionate] (Component B) | — | 0.50 | — | — | — | — | — | — | — | — |
| | polybutenyl succinimide (mono) (Component C) | 0.50 | 0.50 | 0.50 | | | — | — | — | — | — |
| | DBPC(2,6-di-t-butyl-paracrezol) | — | — | 0.50 | — | — | — | — | — | — | — |
| | oleil acid phosphate | — | — | — | — | — | — | 0.50 | — | — | — |
| | pentaerythritoldiolate | — | — | — | — | — | — | — | 0.50 | — | — |
| | Zn-DTP | — | — | — | — | — | — | — | 0.50 | 0.50 | — |
| | industrial stearic acid | — | — | — | — | — | 0.50 | — | — | — | — |
| Evaluation Result | bronze μ | 0.102 | 0.105 | 0.105 | 0.103 | 0.104 | 0.084 | 0.091 | 0.105 | 0.209 | 0.237 |
| | wear area on bronze ($mm^2$) | 0.196 | 0.198 | 0.206 | 0.199 | 0.198 | 0.550 | 0.366 | 0.124 | 0.561 | 0.255 |
| | steel μ | 0.060 | 0.068 | 0.082 | 0.072 | 0.064 | 0.298 | 0.189 | 0.245 | 0.242 | 0.6< |
| | wear area on steel ($mm^2$) | 0.040 | 0.042 | 0.051 | 0.045 | 0.036 | 0.190 | 0.045 | 0.042 | 0.081 | 0.293 |
| | millipore value after aging (mg/100 mL) | 0.0 | 0.0 | 17 | 12 | 36 | — | 85 | 0.4 | 0.0 | — |

(2) Wear Resistance to Copper Metal

The area of wear track on the bronze ball was calculated under the following conditions. The area of wear track is desirably 0.250 $mm^2$ or less in practical use.

Load: 4.9 N

Speed: 8.0 mm/s

Temperature: 80 degrees C.

Friction Material: bronze ball/chrome plated plate

Test Time: 30 min (3) Lubricity to Iron Metal (Friction Coefficient)

A kinematic friction coefficient (steel μ) was measured under the following conditions. The steel μ is desirably 0.100 or less in practical use.

Load: 4.9 N

Speed: 0.2 mm/s

Temperature: 80 degrees C.

Friction Material: SUJ2 steel ball/SPCC-SD plate

1) Base Oil

Mineral oil (hydrogenated modified base oil): a kinematic viscosity at 40 degrees C. of 7.827 $mm^2/s$, density (at 15 degrees C.) of 0.8556 $g/cm^3$ 2) Irganox L-115 manufactured by Ciba Japan Evaluation Result Since the sample oils of Examples 1 and 2 are provided by blending three predetermined components of the invention in the base oil, the sample oils of Examples 1 and 2 exhibit excellent lubricity and wear resistance to both copper metal and iron metal and excellent heat resistance (sludge resistance). In contrast, the sample oils of Comparatives 1 to 8 lacking any one of the three predetermined components of the invention exhibit unsatisfactory lubricity and wear resistance to at least one of the copper metal and iron metal.

The invention claimed is:

1. A lubricating oil composition, comprising, based on a total mass of the lubricating oil composition:

at least 77.9 mass % of a base oil;

from 0.4-0.6 mass % of a dialkyl hydrogen phosphite;

from 0.4-0.6 mass % of a sulfur antioxidant of formula (2)

(2)

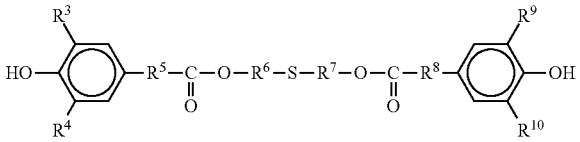

wherein, in formula (2):

$R^3$, $R^4$, $R^9$ and $R^{10}$ are each a tertiary butyl group;

$R^5$ and $R^8$ are each an ethylene group; and $R^6$ and $R^7$ are each an alkylene group; and from 0.4-0.6 mass % of a polyalkenyl succinimide.

2. The composition of claim 1, wherein the dialkyl hydrogen phosphite has formula (1):

(1)

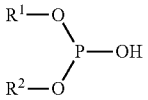

wherein $R^1$ and $R^2$ are each independently an alkyl group having 8 to 16 carbon atoms.

3. The composition of claim 2, wherein the dialkyl hydrogen phosphite of formula (1) is dilauryl hydrogen phosphite.

4. The composition of claim 1, wherein $R^6$ and $R^7$ in formula (2) are each a methylene group.

5. The composition of claim 1, wherein $R^6$ and $R^7$ in formula (2) are each an ethylene group.

6. The composition of claim 1, wherein the polyalkenyl succinimide is polybutenyl succinimide.

7. A shock absorber comprising the composition of claim 1.

8. The composition of claim 1, comprising at least 82.9 mass % of the base oil based on the total mass of the composition.

9. The composition of claim 1, comprising at least 87.9 mass % of the base oil based on the total mass of the composition.

10. The composition of claim 1, comprising at least 92.9 mass % of the base oil based on the total mass of the composition.

* * * * *